US006050212A

United States Patent [19]

Osterlund

[11] Patent Number: 6,050,212

[45] Date of Patent: Apr. 18, 2000

[54] APPARATUS FOR BOOMS

[75] Inventor: Henrik Osterlund, Nordmaling, Sweden

[73] Assignee: Swedish Roto Trading AB, Sweden

[21] Appl. No.: 08/858,154

[22] Filed: Mar. 19, 1997

Related U.S. Application Data

[63] Continuation of application No. PCT/SE95/00407, Apr. 12, 1995.

[30] Foreign Application Priority Data

Apr. 15, 1994 [SE] Sweden ..... 9401289

[51] Int. Cl.[7] ..... B63B 21/00

[52] U.S. Cl. ..... 114/230; 114/270; 405/69

[58] Field of Search ..... 114/270, 230; 405/63, 66, 68, 69

[56] References Cited

U.S. PATENT DOCUMENTS

| | | | |
|---|---|---|---|
| 3,563,036 | 2/1971 | Smith et al. | 405/69 |
| 3,971,220 | 7/1976 | Kinase et al. . | |
| 5,362,180 | 11/1994 | Canning et al. | 405/66 |

FOREIGN PATENT DOCUMENTS

| | | |
|---|---|---|
| 8904279 | 8/1991 | Sweden . |
| 8107776 | 8/1993 | Sweden . |
| 95/28528 | 10/1995 | WIPO . |

*Primary Examiner*—Jesus D. Sotelo
*Attorney, Agent, or Firm*—Pillsbury Madison & Sutro LLP

[57] ABSTRACT

An apparatus for drawing-up and winding-up booms, including self-expanding booms, which are provided with an upper floating body portion and a lower skirt portion, includes a plate arranged on a platform. The plate is rotatable by use of a motor unit, and is provided with a winder positioned generally vertically and at the middle of the plate, and a feeder for feeding-in the boom. Preferably the motor unit can be plugged into and out of the platform, and the plate can be driven by means of a gear pinion which is arranged in the motor unit and goes into engagement with the plate when the motor unit is plugged into the platform. The apparatus includes a support that can be brought into contact with the boom at a border area between upper and lower portions of the boom and can be arranged between the feeder and the platform. The support can be plugged into and out of the platform. An elongated presser is directed in over the platform and can be resiliently applied against the outside of the boom during a winding-up phase, for pressing air out of the boom, the presser being positioned after the support seen in the drawing-up direction of the boom.

6 Claims, 2 Drawing Sheets

APPARATUS FOR BOOMS

This is a Continuation of International Appln. No. PCT/SE95/00407 filed Apr. 12, 1995 which designated the U.S.

BACKGROUND OF THE INVENTION

This invention relates to an apparatus for drawing-up and winding-up booms, preferably so called self-expanding booms, each boom being provided with an upper floating body portion and a lower skirt portion, which apparatus comprises a plate arranged on a platform, which plate is rotatable by means of a motor unit, and which is provided with a winding-up means positioned essentially vertically and essentially at the middle of the plate, and a means for feeding-in the boom, the platform and the motor unit being designed in that way that the motor unit can be plugged into and out of the platform, and the plate being designed in that way that it can be driven by means of a gear pinion which is arranged in the motor unit and goes into engagement with the plate when the motor unit is plugged into the platform.

Such an apparatus is previously known by the allowed and printed Swedish patent application 465.277. This apparatus functions very well in normal cases when winding up booms. In this known apparatus as well as in other apparatuses in the market, however, there can be problems if the the boom, being drawn up, is made extremely dirty with oil. This problem consists of the fact that the boom slides down on the "roll" during the rolling-up phase, whereby the "roll" becomes ungainly and unnecessarily space-requiring.

SUMMARY OF THE INVENTION

This invention intends to remove these problems. This has been made possible by an apparatus of the kind mentioned by way of introduction, which is characterized by the fact that it comprises a combination of the following features:

A supporting means with such a design, that for a supporting purpose it can be brought into contact with the boom at the border area between its upper and lower portions, is intended to be arranged between the feeding means and the platform, the supporting means being intended to be plugged into and out of the platforms.

An elongated pressing means is directed in over the platform and is intended to be resiliently applied against the outside of the boom during the winding-up phase for the same, the pressing means being positioned after the supporting means, seen in drawing-up direction of the boom. Due to this fact there will be an effective evacuation of air out of the boom at the same time as it is secured that during the winding-up phase, the boom will not slide down on the "roll".

BRIEF DESCRIPTION OF THE DRAWINGS

A preferred embodiment of the invention shall be described more closely below with reference to the accompanying drawings, wherein

Referring to FIG. 1, there is shown there the new apparatus. The apparatus comprises a rotatable plate 1, which is arranged on a platform 2. The platform comprises tubular plate girders, which are arranged in that way that there are created two cavities 3*a, b*; 4*a, b*; 5*a, b*; 6*a, b*, functioning as receptacle means and with rectangular cross section at four sides on the outer perimetral edges of the plate, each of which area having an angular distance to each other of about 90°. In any one of these cavities a motor unit 7 can be plugged in, and this motor unit is intended to drive the plate 1 around a vertical axis. When doing that the prong part 8 of the motor unit 7 is pushed into one of the cavities, e.g. the cavity 6*b*. The motor unit 7 comprises a gear pinion 9, which is intended to go into engagement with the plate 1 when the motor unit is plugged in, the peripheral portion of the plate being arranged in that way that it can receive the teeth of the gear pinion in driving relation to the peripheral portion of the plate.

Figure 1:
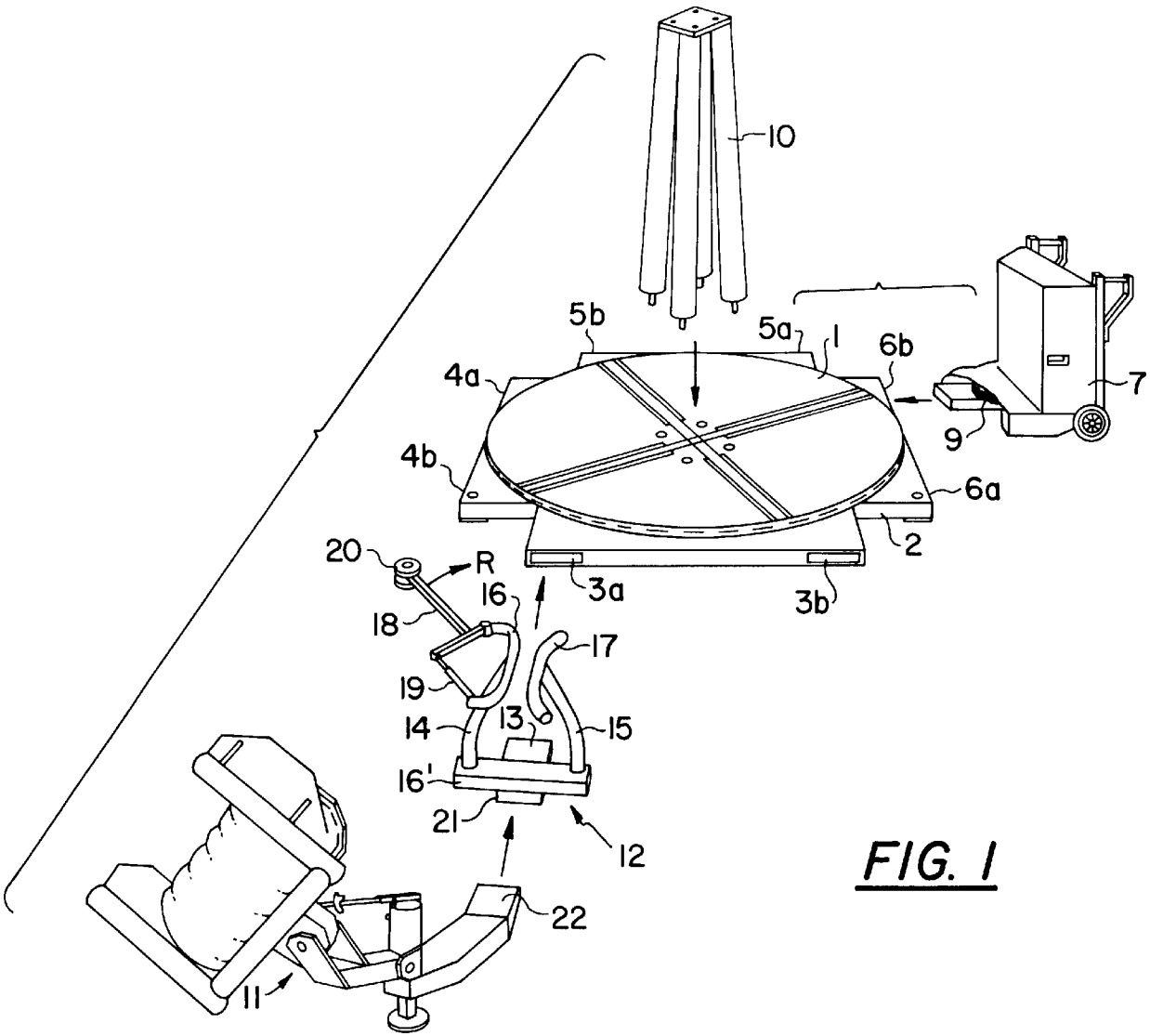
FIG. 1 shows the apparatus taken into pieces (i.e. in a disassembled condition)

The apparatus comprises a winding-up means 10, which is arranged centrally on the plate 1 and around which the boom, taken-up, is intended to be rolled, and a means 11 for feeding-in the boom, which means is arranged in that way that it directs the boom in towards the plate 1 with the winding-up means 10.

According to the invention, the apparatus comprises a supporting means 12, which is intended to be plugged into the platform 2 and accordingly be positioned between the platform and the feeding means 11. The supporting means 12 is provided with a prong means 13 which in this case is intended to be plugged into the cavity 3*a* of the platform 2. The supporting means comprises two arms 14, 15, which are arranged at a distance from each other and each of which projects essentially vertically from a cross-bar 16, which is arranged on the prong means 13. In this connection, the arms 14, 15 are arranged in that way that their upper portions are directed inwards towards each other. Furthermore the arms 14, 15 are intended to be arranged in a way such that they can be raised and lowered. In each of the upper ends of the arms 14, 15 is an essentially horizontal, elongated arm 16', 17 arranged. In this connection, these arms 16', 17 are designed in that way that their end portions are bent outwards. The horizontal arms 16', 17 have a direction which essentially corresponds to the drawing in direction of the boom and the distance between these arms is essentially less than the distance at the bottom between the vertical arms 14, 15. In the end portion of the one arm 16' closest to the platform 2 is an elongated, essentially horizontal pressing means 18 articulately fastened. This pressing means is intended to be influenced in that way by a spring means 19 that it strives inwards in the direction R towards the central portions of the plate. In this connection the spring force of the means 19 shall be so strong that the pressing means 18 is capable of squeezing the boom 23 together so that the air is evacuated from the same. Right out on the pressing means 18 there is arranged a sliding, rolling (i.e., wheel) means 20 for a contact against the object, i.e. the boom. The spring 19 is shown being tensioned between a cross-arm 26 provided on the horizontal pressing means 18, and the arm 16'.

The prong means 13 at its rear portion has a cavity means 21 in which another prong means 22 of the feeding means 11 is intended to be pushed in.

Figure 2:
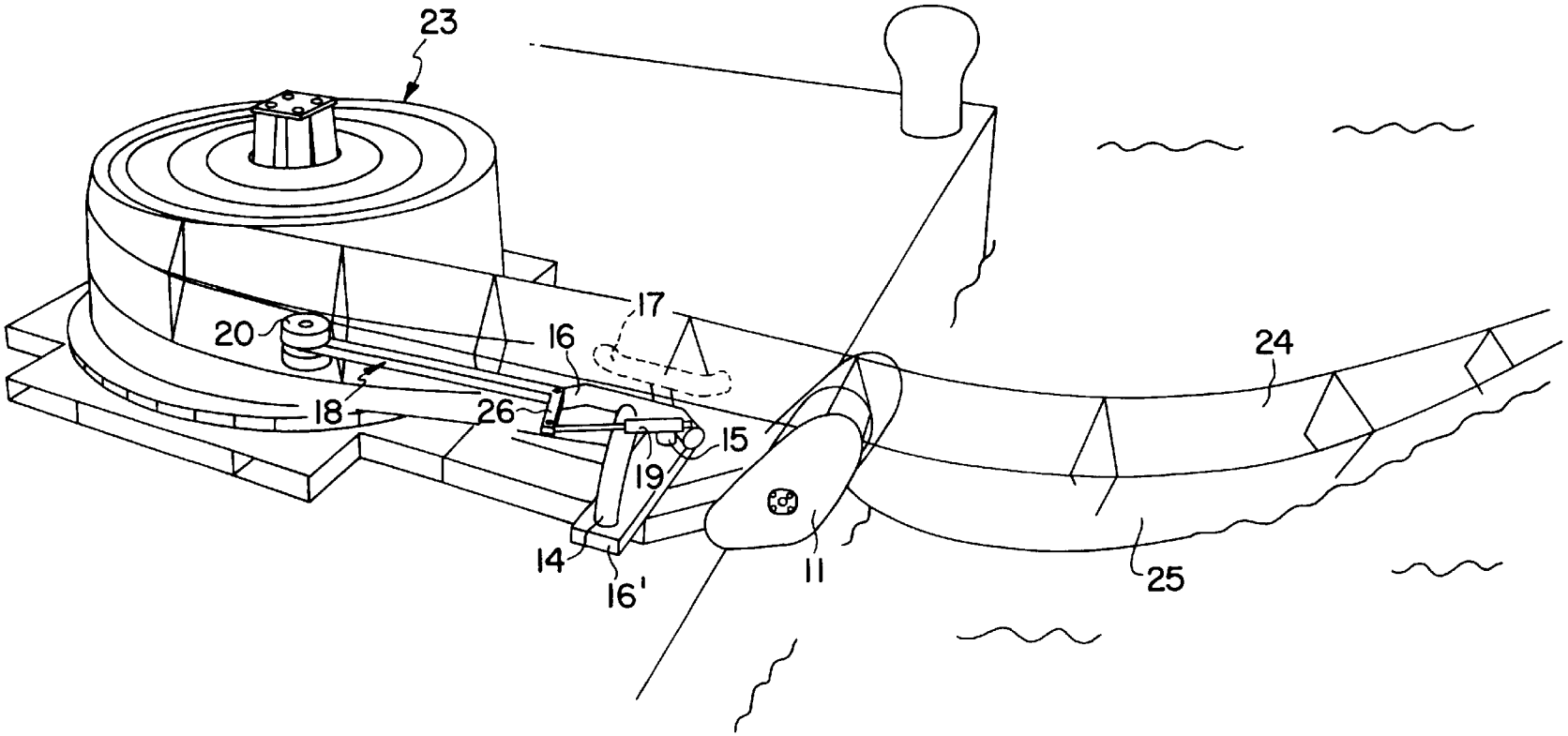
FIG. 2 shows the apparatus mounted together with a boom during the winding-up phase.

In FIG. 2 is shown the winding-up phase for a boom 23 when using the apparatus according to the invention. The boom has an upper floating body portion 24, swelled by air, and a lower, thin skirt portion 25. The one end of the boom 23 is fastended to the winding up means 10, a control being made that the boom ends up between the essentially horizontal means 16', 17 of the supporting means 12. In this connection, these means 16', 17 shall be arranged in that way that the upper floating body portion 24 of the boom is in contact with and slides on the mentioned means. At the same time, it is controlled that the pressing means 18 is in contact with the boom at its outside, and exerts a pressing force against the boom so that the air is pressed out of the floating bodies of the boom, whereby the boom is effectively rolled around the winding-up means 10. Due to the existence of the supporting means 12 and the special design of the same, there is enabled an effective and correct winding-up procedure for the boom around the winding-up means, without the boom being slid down.

The invention is, of course, not limited to the mentioned embodiment, but can be modified within the scope of the following claims. Thus, it is not necessary that the pressing means constitutes an integral part of the supporting means, as is shown in the drawing, but the pressing means can, of course be arranged separately.

I claim:

1. An apparatus for drawing-up and winding-up a self-expanding boom which has an upper, floating body portion, and a lower, skirt potion, comprising:

a generally horizontal platform;

a plate mounted on the platform for rotation about a generally vertical axis, the plate having a winding-up means located generally centrally of the plate and about which the boom is windable upon rotation of the plate about said axis;

a feeding means for feeding-in the boom as the boom is being wound onto the winding-up means;

a motor unit having a motor and having a gear pinion arranged to be rotationally driven by the motor;

said plate having a peripheral portion arranged to be drivingly engaged by the pinion gear for rotating the plate about said axis;

cooperable prong and cavity means provided on said platform and said motor unit for removably and mechanically plugging the motor unit together with the platform, for placing the pinion gear in driving relation to the peripheral portion of the plate;

a supporting means located between said feeding means and said platform and arranged for supporting the boom at a border area between said upper and lower portions of the boom;

cooperable prong and cavity means provided on said platform and said supporting means for removably mechanically plugging the supporting means together with the platform, for supporting the supporting means from the platform; and an elongated pressing means positioned over the platform between the supporting means and the winding-up means and extending towards the winding-up means, and arranged to be resiliently applied against the boom as the boom is being wound onto the winding-up means, for pressing air out of the boom.

2. The apparatus of claim 1, wherein:

said supporting means comprises two arm means which are arranged at a distance from one another, and arranged to have the upper, floating body portion of the boom slidingly rest thereagainst as the boom is being drawn-up in a direction towards said winding-up means.

3. The apparatus of claim 2, wherein:

said arm means extend parallel to said direction.

4. The apparatus of claim 3, wherein:

said supporting means further comprises a support bar having two arms based thereon and which extend upwards from the bar while converging towards one another; said arm means being mounted at corresponding elevated locations on respective ones of said arms.

5. The apparatus of claim 4, wherein:

said arm means have inner end portions located nearer said winding-up means and outer end portions located nearer said feeding means; said inner end portions diverging from one another towards said winding-up means, and said outer end portions diverging from one another towards said feeding means;

said elongated pressing means being pivotally mounted on a respective said inner end portion of one of said arm means, and being resiliently biased by a spring acting between an extension portion of said pressing means, and the outer end portion of said one of said arm means.

6. The apparatus of claim 5, wherein:

said pressing means, at an inner end thereof, has a sliding or rolling means arranged to slidingly or rollingly engage the boom.

* * * * *